United States Patent [19]

Baverstock

[11] 4,430,139

[45] Feb. 7, 1984

[54] APPARATUS FOR MANUFACTURING CABLE

[75] Inventor: John R. Baverstock, Stoke-on-Trent, England

[73] Assignee: Lucas Industries Limited, Birmingham, England

[21] Appl. No.: 428,862

[22] Filed: Sep. 30, 1982

Related U.S. Application Data

[62] Division of Ser. No. 65,854, Aug. 13, 1979, Pat. No. 4,381,208.

[30] Foreign Application Priority Data

Aug. 15, 1978 [GB] United Kingdom ..... 33340/78

[51] Int. Cl.[3] ..... H01B 13/06

[52] U.S. Cl. ..... 156/353; 156/52; 156/73.2; 156/269; 156/271; 156/290; 156/324; 156/359; 156/361; 156/499; 174/72 A; 174/72 TR; 174/117 F; 428/198; 428/294; 428/375; 428/379

[58] Field of Search ..... 156/51, 52, 55, 47, 156/290, 359, 361, 499, 510, 522, 353, 73.2, 291, 324; 174/72 A, 72 TR, 117 F, 117 FF; 428/198, 294, 375, 379

[56] References Cited

U.S. PATENT DOCUMENTS

| | | | |
|---|---|---|---|
| 3,226,278 | 12/1965 | Scofield et al. | 156/47 X |
| 3,836,415 | 9/1974 | Hilderbrandt | 174/117 F X |
| 3,936,344 | 2/1976 | Ball et al. | 156/499 X |

*Primary Examiner*—Robert A. Dawson

*Attorney, Agent, or Firm*—Scrivener, Clarke, Scrivener and Johnson

[57] ABSTRACT

Apparatus is disclosed for bonding a plurality of cores of a multi-core ribbon electric cable in side-by-side relationship by heating the insulation of the cores to bond together the insulation of adjacent cores. Instead of cotinuously bonding the cores together along their entire length, the apparatus is designed to interrupt the bonding at predetermined intervals so that when the cable is cut at a sectional interval it is not necessary to separate the insulation of one core from the next.

32 Claims, 4 Drawing Figures

APPARATUS FOR MANUFACTURING CABLE

This application is a division, of application Ser. No. 065,854, filed Aug. 13, 1979 and now U.S. Pat. No. 4,381,208.

This invention relates to apparatus for manufacturing multi-core electric cables wherein the cores extend in side-by-side, spaced and generally parallel relationship.

The term multi-core cable is used herein to include such cable forms as a flat cable where the spaced parallel cores have a common insulating sheath, and ribbon cable, by which term is meant a flat cable comprising a plurality of leads each having a conductive core in an electrically insulating sheath, the leads being positioned parallel and side-by-side, and the leads being secured together to constitute the cable by having their insulating sheaths interconnected.

There are known forms of ribbon cable wherein the sheaths of the leads are interconnected along their length by being formed integral with one another, having been formed simultaneously around their respective cores. There are other known forms where the sheaths are interconnected along their length by an adhesive which secures each sheath to its neighbour. There are still other known forms of ribbon cable as shown in U.S. Pat. No. 3,226,278 wherein the sheaths are formed from thermoplastic material and are interconnected by fusion of each sheath to its neighbour along its length. In each case the ribbon cable is manufactured as a continuous length which is either cut to predetermined lengths and stored ready for use, or is stored as a continuous length on a reel, and when required a predetermined length of cable is cut from the reel. In order to use the predetermined length of ribbon cable the end regions of the leads thereof must be separated from one another, and if necessary the extremities are stripped of insulation to facilitate making of an electrical connection thereto.

There is also a known form of flat cable wherein a plurality of flat tape-like cores extend in spaced side-by-side parallel relationship and are insulated and held in position relative to one another by upper and lower insulating layers which are interconnected around and between the cores throughout their length by adhesive.

A problem found with flat cable and ribbon cable is the separation of the cores at the end regions of the predetermined lengths of cable. The usual method of separating the leads of ribbon cable is to pull the leads apart, and this is usually a manual, and therefore expensive operation. Moreover the operation entails a high failure rate as a result of one or more of the sheaths of the leads tearing as it is separated from its neighbour. Ideally of course, machines will separate along their common boundary or along the adhesive boundary in the case of adhesively interconnected leads. However it is frequently found that the bond between the sheaths of the leads is too strong to permit separation by pulling the sheaths apart, and tearing of the sheaths of one or more of the leads is the result. Such tearing exposes the conductive core at a region where it should be insulated by its sheath, and often the resultant length of ribbon cable is unusuable, particularly if it has been cut originally to the exact required length. In relation to the aforementioned flat cable the insulating layers are usually cut or scraped away to expose the cores, again a manual and thus expensive operation not without risk of damaging the cores.

It is an object of the present invention to provide apparatus for manufacturing multi-core cable wherein the disadvantages mentioned above are minimised.

It is an important object of the invention to produce multi-core cable at the outset with regions at which individual conductors are separate, having never been interconnected.

The present invention consists in apparatus for manufacturing multi-core cable of the kind in which a plurality of conductive cores are held in parallel and side-by-side relation by surrounding insulation, the formed from thermoplastic material, the apparatus including drive means for driving through the apparatus a plurality of substantially continuous conductive cores in side-by-side, substantially parallel and spaced ralationship, simultaneously with surrounding insulation formed from thermoplastic material, a bonding station including a hot air blower for blowing hot air on the insulation of the cable to heat the insulation and cause fusion of the insulation, and interruptor means for interrupting the heating of the insulation at predetermined regions along the length of the cable, so that in the resultant cable the cores are insulated and held in position relative to one another throughout their length by the surrounding insulation except at said regions wherein the cores are separate from one another.

Each conductive core may have its own insulating sheath and be held in place by bonding the sheaths one to another or to at least one backing strip of insulating material or both to one another and to one or more insulating backing strips, except at the said regions. Alternatively the conductive cores may be bare and be insulated and held in their relative positions by being sandwiched between opposed, for example upper and lower, insulating strips which are bonded one to the other except at the regions.

Alternatively backing strip for conductive cores each having its own insulating sheath may be supplied in lengths corresponding to the fully interconnected lengths of cable and arranged with gaps between successive lengths corresponding to the said regions so that in these regions there is no tape to be bonded to the sheaths. Again, where there is more than one backing strip, one or both backing strips is divided into such successive lengths and on at least one side of the multi-core cable there is no tape to be bonded to the sheaths.

One example of the invention is illustrated in the accompanying drawings, wherein.

Figure 1:
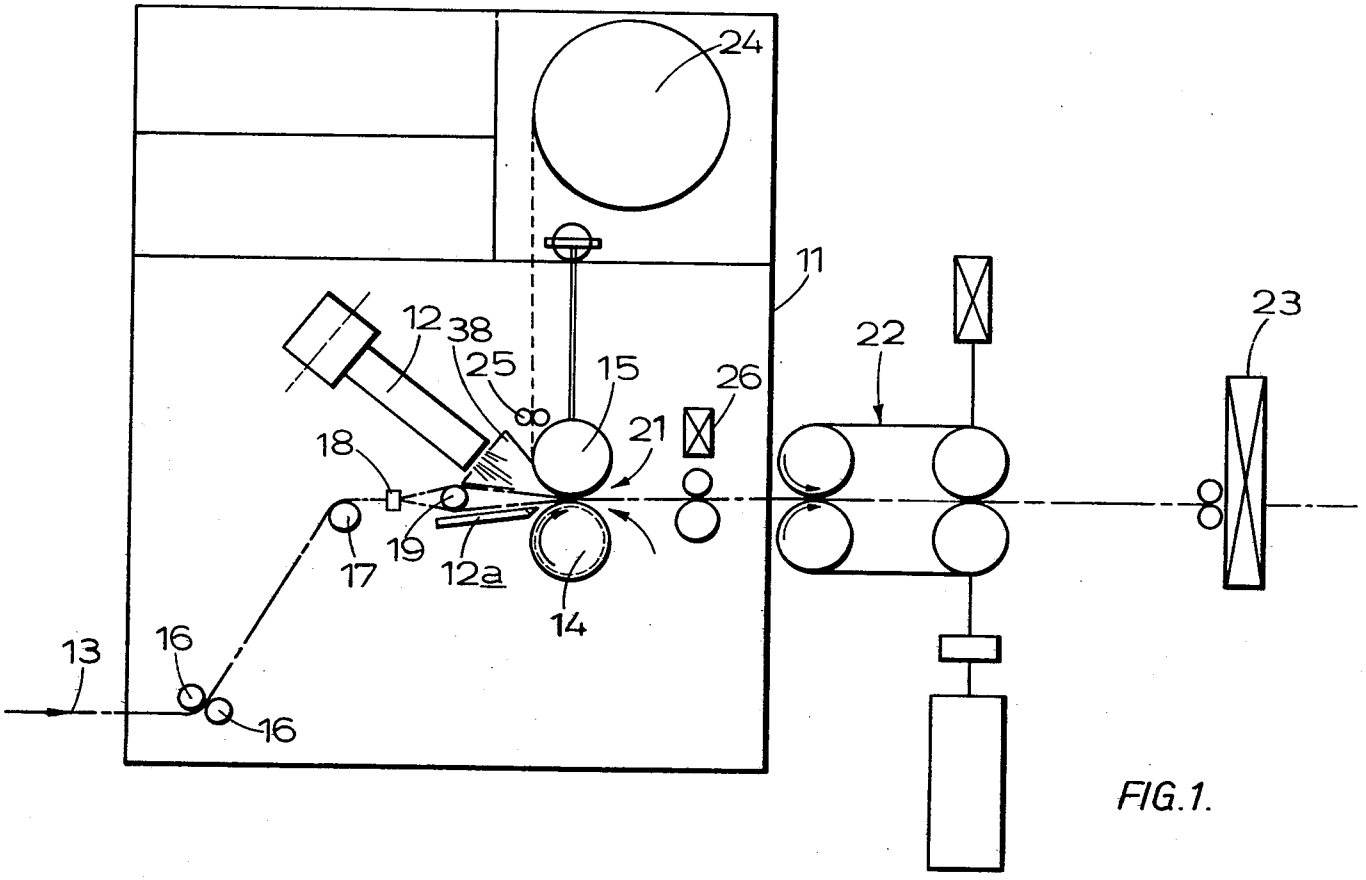
FIG. 1 is a diagrammatic representation of apparatus for producing ribbon cable.

Referring first to FIG. 1 of the drawings, the apparatus comprises a bonding module 11 incorporating a hot air blower 12, a drive mechanism for driving leads through the apparatus, and a programmable control mechanism for controlling operation of the drive, the heater 12 and certain additional elements of the apparatus as will be described more fully hereinafter.

A plurality of conductive leads each comprising a conductive core within a thermoplastic synthetic resin, preferably p.v.c., sheath are drawn from respective storage reels (not shown) and follow the path of the broken line 13 through the apparatus.

The module 11 carries a profile roller 14 which is driven by an electric motor. The roller 14 is formed from aluminium and its cylindrical surface is formed with a plurality of circumferentially extending part circular grooves capable of receiving the leads to be formed into the ribbon cable. Positioned adjacent the roller 14 is a pressure roller 15 the outer surface of which is resilient. The pressure roller 15 is adjustable in position towards and away from the roller 14 and can rotate about an axis parallel to the rotational axis of the roller 14. Leads passing between the rollers 14, 15 are gripped therebetween, and upon clockwise rotation of the roller 14 the leads are drawn through the apparatus. Thus the leads initially pass between a pair of tensioning rollers 16 which ensure that the length of the leads between the rollers 16 and the rollers 14, 15 are maintained at a predetermined tension. After the rollers 16 the leads pass over a guide pulley 17 and through a guide block 18. The guide block 18 ensures that the leads are positioned side-by-side, and between the guide block 18 and the rollers 14, 15 is a cylindrical post 19. Alternate leads pass to one side of the post 19, while the remaining leads pass to the other side of the posts 19. Thus intermediate the post 19 and the roller 14, 15 the leads are separated from one another. The heater 12 is in the form of a hot air blower which directs heated air onto the separated leads between the posts 19 and the rollers 14, 15. The separating action effected by the post 19 ensures that the leads do not mask each other from the flow of hot air.

The fan which drives air through the blower 12, and the heater elements which heat the air are both controlled to ensure that the thermoplastic sheaths of the leads are raised to an appropriate temperature immediately before passing between the rollers 14, 15 such that as the leads pass between the rollers 14, 15 the pressure applied to the leads by the rollers causes the heated thermoplastic sheath of each lead to touch and fuse to the heated thermoplastic sheath of its neighbour. A pair of nozzles 21 direct cold air onto the leads as they pass out from between the rollers 14, 15 and the effect of the cold air is to cool the now fused sheaths of the leads, and also to cool the rollers 14, 15. Thereafter the formed ribbon cable, wherein the leads are positioned side-by-side and parallel, with each thermoplastic sheath fused to its neighbour, is received by a twin conveyor system 22. The conveyor system 22 passes the ribbon cable to a guillotine mechanism 23 which is operated by the control mechanism of the module 11 to cut the ribbon cable into predetermined lengths.

The apparatus described so far will operate to produce ribbon cable wherein the sheaths of the leads are fused each to its neighbour throughout the whole length of the ribbon cable. However, it is desired to produce ribbon cable wherein there is no interconnection between the sheaths in regions predeterminedly spaced along the length of the cable. Thus the control mechanism contained in the module 11 causes interruption of the fusion process at predetermined intervals, the intervals being determined by the passage of time, or more preferably by the passage between the rollers 14, 15 of a predetermined length of the leads. The hot air blower 12 is movable from the operative position wherein it heats the sheaths of the leads to an inoperative position wherein the hot air directed from the blower 12 is received by an extractor duct 38. The direction of movement of the heater is not of importance but in the arrangement shown the heater will be moved laterally with respect to the length of the cable and parallel to the plane of the cable. It is to be recognised that the heater 12 could be moved in other directions to cause it to discharge its air into a suitably positioned duct 38 rather than onto the leads. The movement of the hot air blower 12 from its operative position to its rest position and back to its operative position is controlled by the control mechanism within the module 11. Thus after a predetermined length of ribbon cable has been produced the hot air blower 12 will be moved to its rest position while the rollers 14, 15 will continue to rotate, driving the leads through the apparatus. After a predetermined length of the leads has passed between the rollers, the hot air blower 12 will be returned to its operative position and the cable produced by the apparatus will thus include regions wherein the leads, although still extending side-by-side and parallel to one another, are not interconnected.

As mentioned above the guillotine 23 is also controlled by the control mechanism of the module 11 and its operation is so controlled that the ribbon cable is severed at or adjacent the mid-point of the regions of the cable wherein the leads are not interconnected. Thus the guillotine produces from the ribbon cable a plurality of predetermined lengths of ribbon cable each having end regions wherein the leads are not interconnected.

In order to increase the efficiency of the hot air blower 12 a reflector plate **12*a* is positioned beneath the leads between the posts 19 and the rollers 14, 15, so ensuring that the under surfaces of the sheaths of the leads, in relation to the blower 12** are also heated.

It will be recognised that the form of ribbon cable produced by the apparatus described above has the leads interconnected by fusion of the sheaths of the leads each to its neighbour. However, if desired, the module 11 can include a tape feed mechanism 24 whereby a continuous strip of thermoplastic tape is fed between the rollers 14, 15, simultaneously with the conductive leads. The tape passes from the mechanism 24 between tensioning rollers 25 and passes beneath the roller 15. It will be recognised therefore that one surface of the tape will be heated simultaneously with the heating of the sheaths of the leads. Thereafter, as the leads and the tape pass together between the rollers 14, 15 the sheaths of the lead will be fused each to the tape as well as each to its neighbour. Similarly of course although the tape will continue along the whole length of the ribbon cable in those regions of the cable wherein the sheaths of the leads are not interconnected they will not be fused to the tape either. The guillotine of course will cut through both the tape and the leads.

In a modification the grooves in the roller 14 are arranged to hold the leads separate from one another so that the leads fuse only to the backing strip defined by the tape. Once again when the heater 12 is moved to its rest position, a length of ribbon cable will be produced wherein the leads are not fused to the backing strip. Again therefore after the ribbon cable has been guillotined the cut lengths of ribbon cable will have end regions wherein the leads are separate from one another.

In a further modification an additional tape feed mechanism similar to the tape feed mechanism 24 and tensioning rollers similar to the tensioning rollers 25 may be provided below the level at which the leads are fed between the rollers 14, 15 and feed a continuous lower strip of thermoplastic tape between the rollers 14, 15 to engage the underside of the conductive leads. If necessary the reflector plate 12*a* may be re-positioned to direct hot air onto the surface of the underside tape which will engage the under surfaces of the sheaths of the leads. When the leads and the upper and lower tapes pass together between the rollers 14, 15, the leads are sandwiched between the tapes and the sheaths of the leads will be fused to both the tapes as well as each to its neighbour. As in the previous examples when the heater 12 is moved to its rest position, a length of ribbon cable will be produced wherein the leads are not fused to the tapes nor to one another and again, after the ribbon cable has been guillotined, the cut lengths of ribbon cable will have end regions wherein the leads are separate from one another.

It will be recognised that the control mechanism of the module 11 can be set to produce a wide range of different predetermined spacings between the regions of the cable wherein the leads remain separate from one another.

Moreover if desired the guillotine could be rendered inoperative, and the ribbon cable produced by the apparatus could be stored on a reel, the predetermined lengths then being severed when required.

Where thermoplastic tape on one or both sides of the leads is being used as either the sole means of securing the leads together to form the ribbon cable or alternatively as an adjunct to fusing the sheaths each to its neighbour, two lengths of ribbon cable can be produced simultaneously. The appropriate sets of leads are fed through the apparatus as described above, and a single backing strip on one or each side of the leads, in the form of thermoplastic tape sufficiently wide to lie across both sets of leads is fed from the mechanism 24. After the bonding process a slitting mechanism 26 positioned between the rollers 14, 15 and the conveyor mechanism 22 is operated to continuously slit the tape between the two sets of leads so that two separate ribbon cables pass through the conveyor mechanism 22 to the guillotine 23.

Figure 2:
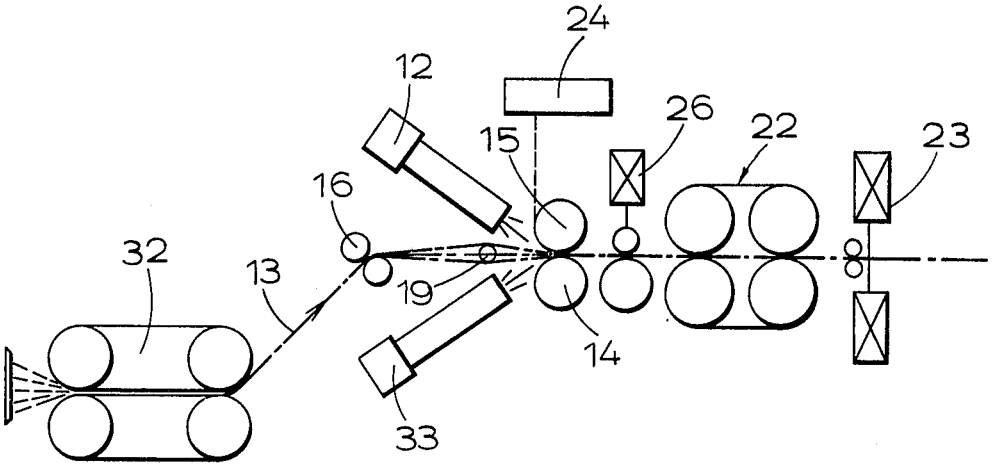
FIG. 2 is a view similar to FIG. 1 of an alternative apparatus.

In the alternative apparatus shown in FIG. 2 components common to the apparatus shown in FIG. 1 carry the same reference numerals. The leads are drawn through the apparatus not by the driving action of the rollers 14, 15 but by the combined action of the twin conveyor unit 22 and a further twin conveyor unit 32 at the inlet of the apparatus. The conveyor unit 22 is driven at a speed in excess of the conveyor unit 32 to ensure that between the conveyors the leads are maintained in tension. In place of the reflector 12*a* the apparatus includes a second hot air blower 33 which directs hot air at the under surfaces of the sheaths of the leads. The second hot air blower 33 is of course moved by the control mechanism in unison with the hot air blower 12 so that in the rest position of both heaters their hot air is received by an extractor duct like the duct 38 in FIG. 1.

As with the apparatus described with reference to FIG. 1 thermoplastic tape can, if desired be fed between the rollers 14, 15 from a tape feed mechanism 24 on one or each side of the leads and again if desired the profiling of the roller 14 can be arranged so that the sheaths of the leads are fused only to the backing tape or tapes. Again, the or each tape can be sufficiently wide to accommodate two ribbon cables in which case the tape slitting mechanism 26 is utilised to separate the two ribbon cables before they pass into the conveyor mechanism 22.

Figure 3:
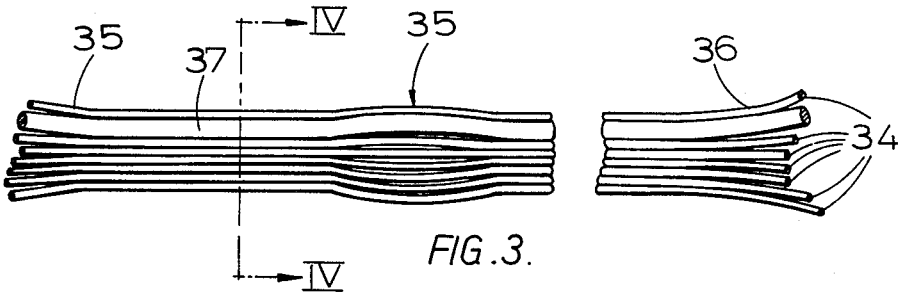
FIG. 3 is a plan view of a length of ribbon cable.
Figure 4:
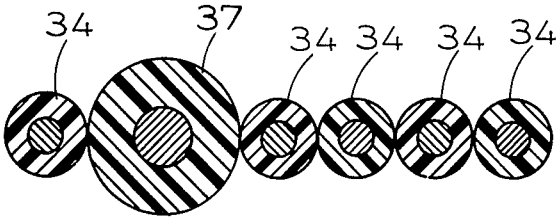
FIG. 4 is a sectional view on line IV—IV of FIG. 3, to an enlarged scale, of a length of ribbon cable.

An example of one form of the ribbon cable which can be produced by the apparatus of FIG. 1 and FIG. 2 is shown in FIG. 3. In the ribbon cable of FIG. 3 the individual leads 34 have their sheaths each fused to the neighbouring sheath to produce a flat ribbon cable wherein the leads extend parallel to one another and in side-by-side relationship. In FIG. 3 there is shown a region 35 of the cable where the leads are not secured together and an end region 36 formed by severing the cable through a region 35. It will be recognised that as the cable is produced the leads within each region 35 will remain side-by-side and parallel though they are shown spaced in FIG. 3 for the purposes of clarity. FIG. 4 shows an enlarged cross-sectional view of a ribbon cable similar to that shown in FIG. 3 and illustrates that it is not essential that all of the leads are of the same diameter. Thus in FIG. 4 an increased diameter lead 37 is incorporated in the cable with a plurality of smaller diameter leads 34. The axis of the increased diameter lead 37 may lie in the same plane as that of the smaller diameter leads 34, as shown in FIG. 4 or the axis of the increased diameter lead 37 may be displaced to one side of the plane containing the axes of the leads 34 so that on one side of the multi-core cable all the sheaths lie at the same level. In the event that thermoplastic tape is utilised as an adjunct to fusing the sheaths of the leads each to its neighbour then of course the tape will be fused to each of the sheaths of the leads and will lie generally in a plane parallel to the central plane of the cable. Moreover where the thermoplastic tape constitutes the means of securing the leads together to form the cable then there will be a small spacing in the lateral dimension of the cable between the leads.

In the examples described above there are those where in addition to the leads having their sheaths bonded together, the sheaths are also bonded, on one or each side of the cable to a continuous length of backing strip in the form of a thermoplastic tape, and those wherein the sheaths are bonded only to the tape or tapes. At predetermined points there is in the one case no fusion between the sheaths of the leads and no fusion between the sheaths and the tape or tapes, and in the other case no fusion between the sheaths and the tape or tapes. In both cases in the severing operation the leads and the tape or tapes are severed simultaneously. However, in a modification, the apparatus, which is arranged to apply tape to one side only of the cable, includes a tape cutter in advance of the bonding module. The tape cutter is controlled by the control module and is operated to sever the tape entering the bonding module to produce lengths of tape equal in length to the distance between adjacent regions of the cable wherein the leads are separate from one another. The apparatus further includes a pause mechanism whereby the feed rollers 25 are stopped and the supply of tape to the bonding module is interrupted to correspond to the period of time when the heating process is interrupted. The tape cutter is disposed below the feed rollers 25 and when the feed rollers 25 are started again after the pause the leading end of the tape is fed down until, assisted by gravity, it makes contact with the leads below. The leads take the leading end of the tape forwards and rethread the tape between the rollers 14 and 15. Thus the cable issuing from the bonding module comprises, in the one case a plurality of leads having portions where their sheaths are fused together and fused to a length of backing strip spaced apart by regions wherein the sheaths are separate from one another, and there is no backing strip and in the other case having portions where the sheaths are bonded to a length of strip spaced apart by regions where there is no strip. In both cases the backing strip has been cut to the appropriate length, and has in effect been positioned by the apparatus so as to correspond only to the portions of the leads wherein the sheaths are interconnected. In the second case, where the sheaths are never bonded together the bonding module can if desired be in a continuously operating mode since the necessary bonding will be achieved by the spacing of the cut ends of consecutive lengths of backing strip. The fact that the sheaths of the leads will be heated in regions where they are not to be bonded to backing strip does not present any serious problems with most sheath materials but of course if desired the heating can be interrupted as described above.

In combination with cut lengths of tape on one side of the cable a continuous length of tape may be applied as a backing strip to the other side of the cable but as this second backing strip is not to be bonded to the leads in the regions where there is no strip on the one side of the cable, it is necessary that in this variant heating be interrupted so that the leads will not be bonded to the second backing strip in the regions in which the leads are required to be separate. Instead of the second backing strip being continuous it too may be in cut lengths corresponding in length and position to those on the one side of the cable. For this purpose a tape cutter as described above and under the control of the pause mechanism may be provided for the lower tape. Provided that the lower tape is sufficiently stiff for its leading end to be projected forward from its feed rollers until it engages the underside of the leads and be taken forward with the leads, the lower tape will be rethreaded between the rollers 14, 15 in a manner generally similar to the rethreading of the upper tape.

It will be recognised since predetermined lengths of ribbon cable can be produced having end regions wherein the leads are separate from one another then the problems found with the known forms of ribbon cable are obviated. Thus since the leads, at the end regions are separate from one another having never been interconnected, then the problems of the prior art in relation to the separation of the leads at the end regions of the length of cable is not found.

The foregoing description has been in relation to ribbon cable wherein the leads each include a conductive core within an individual sheath. However, with relatively minor modifications the apparatus can be used to produce a form of multi-core cable wherein a plurality of bare conductive cores are insulated, and held in position relative to one another by a common electrically insulating sheath. The bonding station receives a plurality of continuous cores in side-by-side parallel spaced relationship and receives above and below the cores respectively upper and lower insulating strips. The insulating strips are thermoplastic tapes generally similar to the thermoplastic tape described above in relation to the backing strip and may be similar in thickness to such backing strips or thicker or thinner. In the bonding station the hot air blower heats the mutually presented surfaces of the upper and lower strips and the rollers between which the cable passes press the upper and lower strips together so that they fuse together between and around the bare cores.

Again, the heating is interrupted at predetermined points along the length of the cable being produced so that the resultant cable has regions wherein the upper and lower strips are fused together between and around the cores and so insulate and hold the cores in position relative to one another interspaced by regions of considerably smaller length in which the upper and lower strips are not interconnected.

Again, the cable is severed in the guillotine either at an end of or at the mid-point of the regions wherein the upper and lower strips are not interconnected, thus producing lengths of flat cable having one or both ends wherein the cores are readily accessible without cutting or scraping the upper and lower strips to expose the cores.

In a modification of the foregoing technique one or both strips can be cut prior to passing through the bonding station and the cut ends of consecutive lengths of the cut strip can be spaced by a pause mechanism so that in the resultant cable the regions where to cores are interconnected are defined by the absence of one or both strips. As with the similar technique mentioned earlier the heater can if desired remain operative or can be interrupted at said regions. Where both strips are cut and spaced then of course there is less need to interrupt the operation of the heater.

Although in the above-described apparatus hot air welding is used to join thermoplastics insulating materials, the insulating material may alternatively be bonded by the use of adhesive or by other known methods of joining synthetic resin materials for example by ultrasonic or high-frequency fusion.

The apparatus, instead of being arranged with the multi-core cable in a horizontal plane could be arranged to produce the multi-core cable in any other convenient orientation thereof. In such re-orientated apparatus opposed insulating strips or tapes on opposite sides of the cable would not then necessarily be upper and lower strips and it must be understood that these terms are used for convenience of description only and are not to be regarded as limitative.

In apparatus in accordance with the invention in which the leads are drawn through the apparatus not by the driving action of rollers (the rollers 14, 15 for example) but by other means such as the twin conveyor units 22 and 32 in FIG. 2, it is not necessary for the rollers 14 and 15 to be driven, they may simply be allowed to rotate under the action of the moving leads. Furthermore in such apparatus used for manufacturing multi-core cable of the kind in which leads with individual insulating sheaths are joined side-by-side without the addition of a backing strip, provided that, as is again the case in the example of FIG. 2, the leads are maintained in tension over the profile roller 14, the pressure roller 15 may be omitted. The tension on the leads and the profile of the roller 14 is sufficient to urge neighbouring sheaths into close contact to become bonded one to another. Omission of the roller 14 has the advantage of avoiding the distortion of the sheaths which is apt to result from pressure of the plain roller 14 on the sheaths softened by heating for bonding purposes.

I claim:

1. Apparatus for manufacturing multi-core cable of the kind in which a plurality of conductive cores are held in parallel and side-by-side relation by surrounding insulation formed from thermoplastic material, the apparatus including drive means for continuously driving through the apparatus a plurality of substantially continuous conductive cores in side-by-side, substantially parallel and spaced relationship, simultaneously with surrounding insulation formed from thermoplastic material, a bonding station including hot air blower means for blowing hot air on the insulation of the cable as the cable passes through the bonding station to heat the insulation and cause fusion of the insulation throughout major portions of the length of the cable, and interruptor means for interrupting the heating of the insulation at predetermined regions along the length of the cable which are short compared to said major portions, so that in the resultant cable the cores are insulated and held in position relative to one another throughout their length by the surrounding insulation except at said regions wherein the cores are separate from one another.

2. Apparatus for manufacturing multi-core cable according to claim 1 wherein the interruptor means includes diverter means for diverting the hot air from the insulation to interrupt the heating of the insulation.

3. Apparatus for manufacturing multi-core cable according to claim 2 wherein the hot air diverted from the insulation is received by an extractor duct.

4. Apparatus for manufacturing multi-core cable according to any one of preceding claims 1 to 3 wherein the apparatus further includes a guillotine whereby as the cable is produced it is severed at said regions to produce predetermined lengths of cable having at least one end region in which the cores are not interconnected.

5. Apparatus for manufacturing multi-core cable according to claim 4 wherein the guillotine severs the cable at or near the mid points of said regions so that the lengths of cable produced have both end regions wherein the cores are not interconnected.

6. Apparatus for manufacturing multi-core cable of the kind in which a plurality of conductive cores are held in parallel and side-by-side relation by surrounding insulation formed from thermoplastic material, the apparatus including drive means for continuously driving through the apparatus a plurality of leads in side-by-side, substantially parallel relationship, each lead including a conductive core surrounded by an insulating sheath formed from thermoplastic material, a bonding station including contacting means for urging the sheaths of the leads into close contact and hot air blower means for blowing hot air on the sheaths as they pass through the bonding station to heat the sheaths and cause fusion of the sheaths each to its neighbour throughout major portions of their lengths, and interruptor means for interrupting the heating of the sheaths at predetermined regions along the length of the cable which are short compared to said major portions, so that at said predetermined regions in the resultant cable the leads are separate from one another.

7. Apparatus for manufacturing multi-core cable according to claim 6 wherein the interruptor means includes diverter means for diverting the hot air from the sheaths to interrupt the heating of the sheaths.

8. Apparatus for manufacturing multi-core cable according to claim 7 wherein the hot air diverted from the sheaths is received by an extractor duct.

9. Apparatus for manufacturing multi-core cable according to any one of claims 6 to 8 wherein the contacting means comprises locating means and means for maintaining tension on the leads past the locating means and co-operating with the locating means to urge the sheaths into close contact during bonding.

10. Apparatus according to claim 9 wherein the locating means is a profile roller.

11. Apparatus for manufacturing multi-core cable according to claim 6 wherein the contacting means includes pressure means which presses the heated sheaths each against its neighbour to fuse the sheaths each to its neighbour.

12. Apparatus for manufacturing multi-core cable according to any one of preceding claims 6 to 8 wherein the apparatus further includes a guillotine whereby as the cable is produced it is severed at said regions to produce predetermined lengths of cable having at least one end region in which the sheaths are not interconnected.

13. Apparatus for manufacturing multi-core cable according to claim 12 wherein the guillotine severs the cable at or near the mid points of said regions so that the lengths of cable produced have both end regions wherein the sheaths are not interconnected.

14. Apparatus for producing multi-core cable according to claim 6 wherein the apparatus includes on at least one side of the cable means for supplying backing strip formed from thermoplastic material from a continuous supply to the bonding station, the hot air blower means also blows hot air on the backing strip or strips to heat the strip or strips and cause fusion of the sheaths also to said backing strip or strips throughout said major portions, and said interruptor means also interrupts the heating of the strips at said predetermined regions, so that at said regions the sheaths are bonded neither each to its neighbour nor to said backing strip or strips.

15. Apparatus for manufacturing multi-core cable according to claim 14 wherein the interruptor means includes diverter means for diverting the hot air from the sheaths and the backing strip or strips to interrupt the heating of the sheaths and the backing strip or strips.

16. Apparatus for manufacturing multi-core cable according to claim 15 wherein the hot air diverted from the sheaths and the backing strip or strips is received by an extractor duct.

17. Apparatus for manufacturing multi-core cable according to any one of preceding claims 14 to 16 wherein the apparatus further includes a guillotine whereby as the cable is produced it is severed at said regions to produce predetermined lengths of cable having at least one end region in which the sheaths are not interconnected.

18. Apparatus for manufacturing multi-core cable according to claim 17 wherein the guillotine severs the cable at or near the mid points of said regions so that the lengths of cable produced have both end regions wherein the sheaths are not interconnected.

19. Apparatus for producing multi-core cable according to any one of preceding claims 6 to 8 wherein the apparatus includes on at least one side of the cable means for feeding backing strip from a continuous supply to the bonding station, cutter means in the path of the strip, or of at least one of the strips, to the bonding station for cutting the strip, control means for operating the cutter means to cut the strip into lengths substantially equal in length to said major portions, and pause means associated with the strip feed for spacing the cut ends of consecutive lengths, whereby said hot air blower means also blows hot air on said lengths of backing strip as they are fed into the bonding station to heat the lengths of strip and cause fusion of the lengths of strip to the sheaths of the leads throughout said major portions, there being no backing strip on at least one side of the cable, at said regions wherein the sheaths are separate from one another.

20. Apparatus for manufacturing multi-core cable according to claim 19 wherein the apparatus further includes a guillotine whereby as the cable is produced it is severed at said regions to produce predetermined lengths of cable having at least one end region in which the sheaths are not interconnected.

21. Apparatus for manufacturing multi-core cable according to claim 20 wherein the apparatus further includes a guillotine whereby as the cable is produced it is severed at said regions to produce predetermined lengths of cable having at least one end region in which the sheaths are not interconnected.

22. Apparatus for manufacturing multi-core cable of the kind in which a plurality of conductive cores are held in parallel and side-by-side relation by surrounding insulation formed from thermoplastic material, the apparatus including drive means for continuously driving through the apparatus a plurality of leads, each including a conductive core in an insulating sheath formed from thermoplastic material, in side-by-side, substantially parallel and spaced relationship, simultaneously with backing strip also formed from thermoplastic material, from a continuous supply on at least one side of the leads, à bonding station including hot air blower means and pressure means, the hot air blower means blowing hot air on the sheaths of the leads and the backing strip or backing strips as the sheaths and the backing strip or backing strips pass through the bonding station, and the pressure means pressing the heated sheaths of the leads against the heated backing strip or strips to cause fusion of the sheaths to the backing strip or strips throughout major portions of the lengths of the leads, and interruptor means for interrupting the heating of the sheaths and the backing strip or strips at predetermined regions along the length of the cable which are short compared to said major portions, so that at said predetermined regions in the resultant cable the sheaths are not interconnected by the backing strip or strips.

23. Apparatus for manufacturing multi-core cable according to claim 22 wherein the interruptor means includes diverter means for diverting the hot air from the sheaths and the backing strip or strips to interrupt the heating of the sheaths and the backing strip or strips.

24. Apparatus for manufacturing multi-core cable according to claim 23 wherein the hot air diverted from the sheaths and the backing strip or strips is received by an extractor duct.

25. Apparatus for manufacturing multi-core cable according to any one of preceding claims 22 to 24 wherein the apparatus further includes a guillotine whereby as the cable is produced it is severed at said regions to produce predetermined lengths of cable having at least one end region in which the sheaths are not interconnected.

26. Apparatus for manufacturing multi-core cable according to claim 25 wherein the guillotine severs the cable at or near the mid points of said regions so that the lengths of cable produced have both end regions wherein the sheaths are not interconnected.

27. Apparatus for manufacturing multi-core cable of the kind in which a plurality of conductive cores are held in parallel and side-by-side relation by surrounding insulation formed from thermoplastic material, the apparatus including drive means for continuously driving through the apparatus a plurality of substantially continuous, conductive cores in side-by-side, substantially parallel and spaced relationship, simultaneously with opposed substantially continuous insulating strips formed from thermoplastic material, a bonding station wherein the opposed strips are bonded together around and between said cores, the bonding station including hot air blower means and pressure means, the hot air blower means heating the mutually presented surfaces of the strips as the strips pass through the bonding station and the pressure means pressing the heated surfaces of the strips together around and between the cores so that the strips fuse together to effect the bond therebetween throughout major portions of their lengths, and interruptor means for interrupting the heating of the opposed strips at predetermined regions along the length of the cable which are short compared to said major portions, so that in the resultant cable the cores are insulated and held in position relative to one another throughout their length by the bonding together of said opposed strips except at said regions.

28. Apparatus for manufacturing multi-core cable according to claim 27 wherein the opposed insulating strips are upper and lower insulating strips.

29. Apparatus for manufacturing multi-core cable according to claim 27 wherein the interruptor means includes diverter means for diverting the hot air from the insulating strips to interrupt the heating of the strips.

30. Apparatus for manufacturing multi-core cable according to claim 29 wherein the hot air diverted from the insulating strips is received by an extractor duct.

31. Apparatus for manufacturing multi-core cable according to any one of preceding claims 27 to 30 wherein the apparatus further includes a guillotine whereby as the cable is produced it is severed at said regions to produce predetermined lengths of cable having at least one end region in which the cores are not interconnected by the strips.

32. Apparatus for manufacturing multi-core cable according to claim 31 wherein the guillotine severs the cable at or near the mid points of said regions so that the lengths of cable produced have both end regions wherein the cores are not interconnected.

* * * * *